455/3

United States Patent [19]

Watanabe

[11] 4,198,624

[45] Apr. 15, 1980

[54] ALARM SYSTEM

[75] Inventor: Masakatsu Watanabe, Tokyo, Japan

[73] Assignee: Hochiki Corporation, Tokyo, Japan

[21] Appl. No.: 901,311

[22] Filed: Apr. 28, 1978

[30] Foreign Application Priority Data

May 2, 1977 [JP] Japan ..... 52-51074

[51] Int. Cl.[2] ..... G08B 26/00

[52] U.S. Cl. ..... 340/505; 340/531; 455/3

[58] Field of Search ..... 340/502, 503, 504, 531, 340/505, 171 R, 171 A, 171 PF, 152 T, 151; 325/308, 31; 358/84, 86

[56] References Cited

U.S. PATENT DOCUMENTS

| | | | |
|---|---|---|---|
| 3,676,580 | 7/1972 | Beck | 325/308 |
| 3,737,858 | 6/1973 | Turner | 340/151 |
| 3,765,016 | 10/1973 | Bert | 340/517 |
| 3,863,222 | 1/1975 | Horowitz | 340/171 PF |
| 3,996,578 | 12/1976 | Takeuchi | 340/517 |
| 4,066,966 | 1/1978 | Takeuchi | 325/308 |
| 4,114,150 | 9/1978 | Yamazaki | 325/308 |
| 4,139,843 | 2/1979 | Watanabe | 340/505 |
| 4,148,021 | 4/1979 | Watanabe | 340/505 |
| 4,162,488 | 7/1979 | Silverman et al. | 340/152 T |

FOREIGN PATENT DOCUMENTS 486622 6/1971 Japan .

*Primary Examiner*—Gareth D. Shaw
*Assistant Examiner*—Joel Miller
*Attorney, Agent, or Firm*—Haseltine, Lake & Waters

[57] ABSTRACT

In an alarm system utilizing a bidirectional wired television system, a large number of subscribers are located in a plurality of group units, whereby first specified frequencies which are common to respective of the group units but are different for the subscribers in each group unit are assigned to the respective subscribers in the respective group units to which are assigned another second specified frequencies which are different from one another, and still another third specified frequencies which are different for a plurality of types of alarms are assigned to the plurality of types of alarms. The group units are polled from a central station for each type of the plurality of alarms by means of interrogating signals comprising the signals of the second specified frequencies and the signals of the third specified frequencies, so that when an abnormal condition exists at any of the subscriber locations in the polled group units, the subscriber generates a signal of the first specified frequency assigned thereto to answer to the polling for that type of alarm corresponding to the abnormal condition. The central station discriminates and displays the answering subscriber and type the alarm condition in accordance with the frequency of the answer signal and the second and third specified frequencies generated for the polling at the time when the answer was made.

8 Claims, 12 Drawing Figures

ALARM SYSTEM

BACKGROUND OF THE INVENTION

The present invention relates to an alarm system utilizing a bidirectional wired television system, such as, a bidirectional community antenna television system or CATV system.

The known systems for providing an alarm service to a large number of subscribers from a remotely located centralized station or central station include the polling systems of the type as disclosed in U.S. Pat. No. 3,765,016 in which a plurality of subscribers are sequentially interrogated from a central station to answer if there has occurred any abnormal condition and the contention systems of the type as disclosed in U.S. Pat. No. 3,996,578 in which those subscribers detecting the occurrence of an abnormal condition in their monitoring areas send alarm signals to a central station.

The network of coaxial cables for the CATV system is generally so arranged that the coaxial cables are branched off to the subscribers. U.S. Pat. No. 3,765,016 discloses a system in which a central station is connected to a transmission loop including a plurality of series connected subscribers and a normally closed line relay is connected in series with each of the subscribers in the loop, and consequently this system cannot be carried out by utilizing the above-mentioned branched CATV network of coaxial cables as such. Another disadvantage of this prior art system is that since the interrogating signal used for polling is in the form of a pulse code signal and since the subscribers are connected in series with the transmission line, the cycle time required for polling is long and consequently if the number of subscribers is large, the time interval from an interrogating signal until the subscriber receives the next interrogating signal is increased, thus making it impossible to send an early alarm.

On the other hand, with the contention type alarm system disclosed in U.S. Pat. No. 3,996,578, different frequencies are assigned to the respective subscribers and another different frequencies are assigned to the respective group units each including a plurality of subscribers whereby any subscriber sending an alarm is discriminated in accordance with the values of the frequencies, and thus it is necessary to use a large number of frequency discriminating devices such as demodulators, tuners or band pass filters. Another disadvantage is that where alarm signals include signals which indicate the types of abnormal conditions, such as, fire, burglary and gas leakage and the central station is required to discriminate the types, the assignment of frequencies becomes increasingly difficult with an increase in the number of subscribers and consequently there exists inevitably an upper limit to the number of subscribers in order that the subscribers as well as the types of abnormal conditions may be effectively discriminated within a limited frequency band.

SUMMARY OF THE INVENTION

It is an object of the present invention to provide an alarm system in which the number of frequencies used is not so large that it is possible to handle a large number of subscribers.

It is also another object to construct the system inexpensively and considerably reduce the time required for sending an alarm.

It is another object of this invention to provide an alarm system in which a large number of subscribers are combined in a plurality of group units and the subscribers in the respective group units are simultaneously interrogated for each type of a plurality of different abnormal conditions, whereby when a plurality of the subscribers in the same group units answer to the interrogation, the answer signals are simultaneously sent to the central station and the discrimination of the subscribers is effected in accordance with the specified frequencies assigned to the subscribers, thus reducing the polling cycle time.

It is still another object of the invention to provide an alarm system in which the occurrence of abnormal conditions including the breaking of the cable lines to the respective subscribers can be detected by polling the subscribers from a central station.

Thus, in accordance with the present invention there is provided an alarm system in which a central station is connected to the output side of a head end of a coaxial cable network for a bidirectional wired television system so that interrogating signals for polling are transmitted as down-signals from the central station to a plurality of subscribers by way of the coaxial cable network and answer signals from the subscribers are in turn received as up-signals by the central station through the coaxial cable network. The plurality of subscribers are located in a plurality of group units and specified frequencies which are common for the respective group units but are different for the respective subscribers in each of the group units are assigned to the subscribers in the group units. Other specified frequencies which are different from one another are also assigned to the respective group units, and consequently any subscriber in any group unit can be specified by the combination of the corresponding two frequencies in these assigned frequencies. In addition, still other specified frequencies which differ for different types of alarms are asigned to a plurality of different types of alarms, such as, fire, burglary and gas leakage, thus making it possible to determine the type of alarm corresponding to an answer signal received from the specified subscriber.

The central station transmits interrogating signals each comprising a signal component of one of the specified frequencies assigned to the group units and another signal component of one of the specified frequencies assigned to the different types of alarms, and the subscribers are polled by these signals. In this case, each of the group unit may be successively polled for every one of the different types of alarms or alternately it is possible to sequentially poll all the group units for one type of the alarms, then poll the group units similarly for the next type of the alarms and so on, and the former method is preferable in cases where the number of the group units is greater than the number of types of the alarms since it reduces the polling cycle time, whereas the latter method is preferred for the same reason in the reverse cases. All the subscribers are sequentially polled group by group for every type of the alarms, so that the subscriber who detects a certain type of abnormal condition transmits an answer signal to the central station of the specified frequency assigned to the subscriber when it receives an interrogating signal comprising the specified frequency component corresponding to the type of the alarm corresponding to the type of the abnormal condition detected and the specified frequency component corresponding to the group unit to which the subscriber belongs. When this answer signal is received, the central station discriminates the specified frequency of the answer signal, and the central station discriminates and displays the location of the answering subscriber and the type of the abnormal condition in accordance with the result of the discrimination and the combination of the above-mentioned two frequency components in the interrogating signal which caused the answer signal.

In accordance with the invention, as mentioned previously, instead of polling the subscribers one by one in a predetermined sequence, the subscribers are polled group by group for the alarms type by type or alternately the respective group unit is polled for the alarms type by type. Consequently, the total number of pollings will be equal to the product of the number of group units and the number of types of alarms, and this is usually far smaller than the total number of subscribers, thus proving to be effective in reducing the polling cycle time and allowing early alarming. When a plurality of subscribers in the same group unit simultaneously answer on an alarm of the same type, these subscribers are discriminated from one another in accordance with the specified frequencies assigned to them.

The above and other objects and advantages of the present invention will be apparent from the following description of the preferred embodiments, accompanying drawings and attached claims.

DESCRIPTION OF THE PREFERRED EMBODIMENTS

Figure 1:
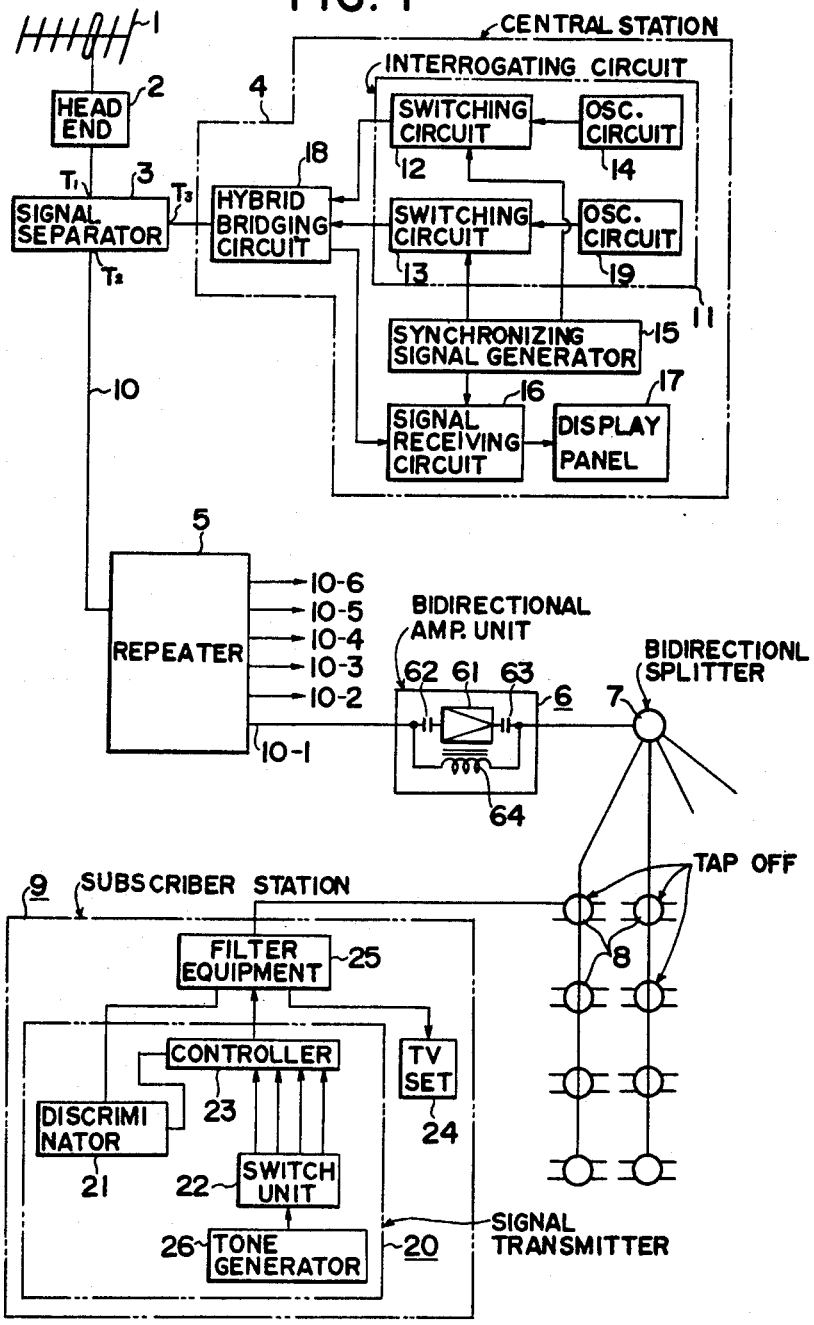
FIG. 1 is a block diagram showing the overall construction of an alarm system according to an embodiment of the present invention.

In FIG. 1, a signal separator 3 is connected to a coaxial cable 10 connected to a CATV system community antenna 1 through a head end 2, and a central station 4 is connected to the signal separator 3. The coaxial cable 10 is connected to a repeater 5 where the coaxial cable 10 is divided into a plurality of branch coaxial cables 10-1, 10-2, . . . , 10-6. The branch coaxial cables 10-1 to 10-6 identical, and as shown by way of example in the Figure, the cable 10-1 is connected through a bidirectional amplifier unit 6 to a bidirectional spliter 7 from which the cable 10-1 is further branched and connected to a plurality of tap-offs 8. A plurality of subscriber stations 9 are connected to each of the tap-offs 8 and each of the subscriber stations 9 includes a television receiving set 24. While only one of the subscriber stations 9 is shown, a plurality of the subscriber stations are connected to each of the tap-offs, and it is assumed here that with each branch coaxial cable taken as a unit, a large number of the subscriber stations constitute a CATV coaxial cable network which is divided into a plurality of group units. The central station 4 includes an interrogating circuit 11 which transmits interrogating signals comprising signal components for sequentially accessing the branch coaxial cables 10-1 to 10-6 in the repeater 5 and another signal components for sequentially accessing all of the plurality of subscriber stations belonging to the accessed branch coaxial cables for each of a plurality of types of alarms such as fire, burglary, gas leakage and emergency. This interrogating circuit 11 includes a combination of a switching circuit 12 and an oscillator circuit 14 for sequentially generating the necessary signal components to access the subscriber stations for the alarms type by type and a combination of another switching circuit 13 and another oscillator 19 for sequentially generating the required signal components to sequentially access the branch coaxial cables. Specified frequencies, e.g., high frequencies different from one another, are assigned to the oscillator circuit 14 for the respective types of the alarms, and other specified frequencies, e.g., low frequencies which are different from one another are assigned to the oscillator circuit 19 for the respective branch coaxial cables. The central station 4 further includes a synchronizing signal generator 15 for sequentially applying scanning signals to the switching circuits 12 and 13, a signal receiving circuit 16 for receiving answer signals from the subscriber stations 9 to discriminate the locations of the subscriber stations sending the answer signals and the types of the alarms and to generate the corresponding outputs, a display panel 17 responsive to the output of the signal receiving circuit 16 to simultaneously display the location of the subscriber station sending the answer and the type of the alarm and a hybrid bridging circuit 18 adapted to mix the two signal components of the interrogating signal and transmit the signal as a down-signal to the coaxial cable 10 through the signal separator 3 and also adapted to receive the answer signal applied as an up-signal from the coaxial cable 10 through the signal separator 3 and apply the signal to the signal receiving circuit 16.

Figure 6A:
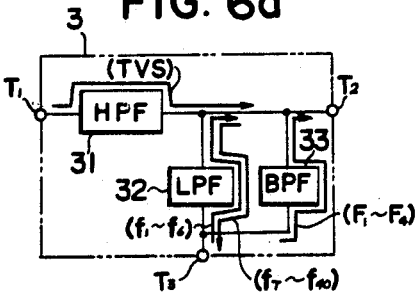
FIG. 6*a* is a block diagram showing in detail an exemplary construction of the signal separator shown in FIG. 1.

The construction of the signal separator 3 is shown in detail in FIG. 6*a*, and the signal separator 3 is designed so that a television signal TVS applied to a first terminal $T_1$ from the head end 2 is transmitted to the coaxial cable 10 through a high-pass filter 31 and a second terminal $T_2$, the interrogating signal components $F_1$ to $F_4$ and $f_1$ and $f_6$ which are applied to a third terminal $T_3$ from the central station 4 are transmitted to the coaxial cable 10 through a high frequency band-pass filter 33, a low-pass filter 32 and the second terminal $T_2$, and the answer signals of $f_7$ to $f_{40}$ applied to the second terminal $T_2$ from the cable 10 are transmitted to the central station 4 through the low-pass filter 32 and the third terminal $T_3$.

Figure 2:
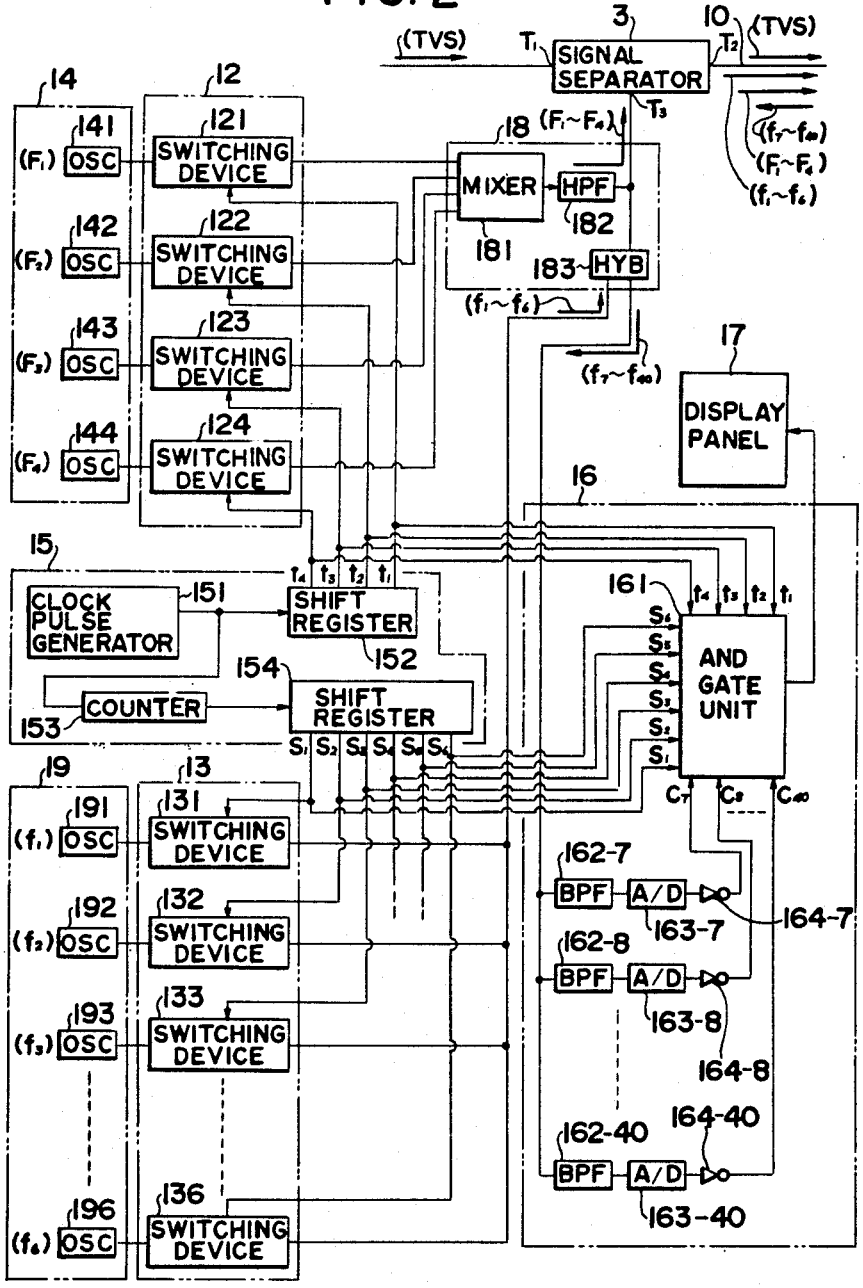
FIG. 2 is a block diagram showing in detail an exemplary construction of the central station shown in FIG. 1.

FIG. 2 illustrates a detailed exemplary construction of the central station 4. In the Figure, the oscillator circuit 14 comprises four high frequency oscillators 141, 142, 143 and 144 for respectively generating the signal components of the different high frequencies $F_1$, $F_2$, $F_3$ and $F_4$, and the switching circuit 12 comprises switching devices 121, 122, 123 and 124 which are responsive to control signals $t_1$ to $t_4$ to selectively apply the outputs of the high frequency oscillators to a mixer 181 in the hybrid bridging circuit 18. The high frequencies $F_1$ to $F_4$ may for example, be assigned so that $F_1$ is used for fire alarm, $F_2$ for gas leakage alarm, $F_3$ for crime preventive emergency alarm and $F_4$ for absence signal. Since these four high frequency signal components must be transmitted to the end terminals of the CATV system, a frequency band near the television signal should preferably be selected as the frequency band of these components so as to ensure effective utilization of the transmission characteristic of the CATV coaxial cable network. For example, if frequencies are used for the $F_1$ to $F_4$ which fall within a frequency band extending between the upper limit of the FM broadcast band and the lower limit of the high channel VHF television broadcast band (108 to 174 MHz), the second high harmonic components of $F_1$ to $F_4$ will also come within the frequency band (216 to 470 MHz) extending between the upper limit of the high channel VHF television broadcast band and the lower limit of the UHF television broadcast band, thus preventing the second high harmonic components of the signals $F_1$ to $F_4$ from causing beat interference on the screen of the television receivers.

The switching devices 121 to 124 comprise for example, high frequency class A transistor amplifiers circuits in which the amplifying transistors are subjected to bias control in such a manner what when the control signals $t_1$ to $t_4$ are not received, the class A amplifier circuits are biased more deeply than the class C amplifier circuit, whereas when the control signals $t_1$ to $t_4$ are received, the amplifier circuits operate as class A amplifiers to apply the input signals $F_1$ to $F_4$ to the mixer 181. The oscillator circuit 19 for selecting the group units for the branch coaxial cables, comprises in the illustrated embodiment six low frequency oscillators 191 to 196 for generating the signal components of frequencies $f_1$ to $f_6$ respectively corresponding to the six branch coaxial cables 10-1 to 10-6, and the switching circuit 13 which is responsive to control signals $S_1$ to $S_6$ to selectively apply as down-signals the outputs of the low frequency oscillators to the coaxial cable 10 through a hydrid coupler 183 of the hydrid bridging circuit 18 and the signal separator 3, comprises switching devices 131 to 136 which may for example, be analog switching devices for transistor switching circuits which deliver the input signals to the output terminals in response to the application of the control signals $S_1$ to $S_6$. The frequencies $f_1$ to $f_6$ are selected for example, to be low frequencies in a frequency band of 1 to 4 KHz.

The signal receiving circuit 16 comprises band-pass filters 162-7 to 162-40 for separating into the frequencies $f_7$ to $f_{40}$ the answer signals of frequencies $f_7$ to $f_{40}$ which are received as up-signals from the subscriber stations 9 through the signal separator 3 and the hybrid coupler 183, analog-to-digital converters 163-7 to 163-40 which are respectively connected to the output terminals of the band-pass filters 162-7 to 162-40, inverters 164-7 to 164-40 respectively connected to the output terminals of the converters 163-7 to 163-40, and an AND gate unit 161 for receiving the control signals $t_1$ to $t_4$ and $S_1$ to $S_6$ and the output signals $C_7$ to $C_{40}$ of the inverters to apply to the display panel 17 the energizing signals corresponding to the answering subscribers and the types of the alarms. The frequencies $f_7$ to $f_{40}$ may be low frequencies which are within the band of 1 to 4 KHz as in the case of the frequencies $f_1$ to $f_6$, and in the present embodiment the frequencies $f_1$ to $f_{40}$ are assigned by separating them with a interval of 30 to 100 Hz in this band. By thus assigning the frequencies $f_1$ to $f_{40}$, the band-pass filters 162-7 to 162-40 as well as band-pass filters 56-1 to 56-6 which will be described later, may each comprise a mechanical filter, such as, tone filter employing a tuning fork corresponding to one of the frequencies of 1 to 4 KHz.

The synchronizing signal generator 15 comprises a clock pulse generator 151 for generating clock pulses of a predetermined period, a shift register 152 for sequentially generating the control signals $t_1$ to $t_4$ at its four output terminals by generating a "1" signal at one of the four output terminals in response to each clock pulse applied, a counter 153 for generating an output each time four clock pulses are counted, and another shift register 154 for generating the control signals $S_1$ to $S_6$ sequentially at its six output terminals by generating a "1" signal at one of the output terminals in response to each output of the counter 153.

Figure 3:
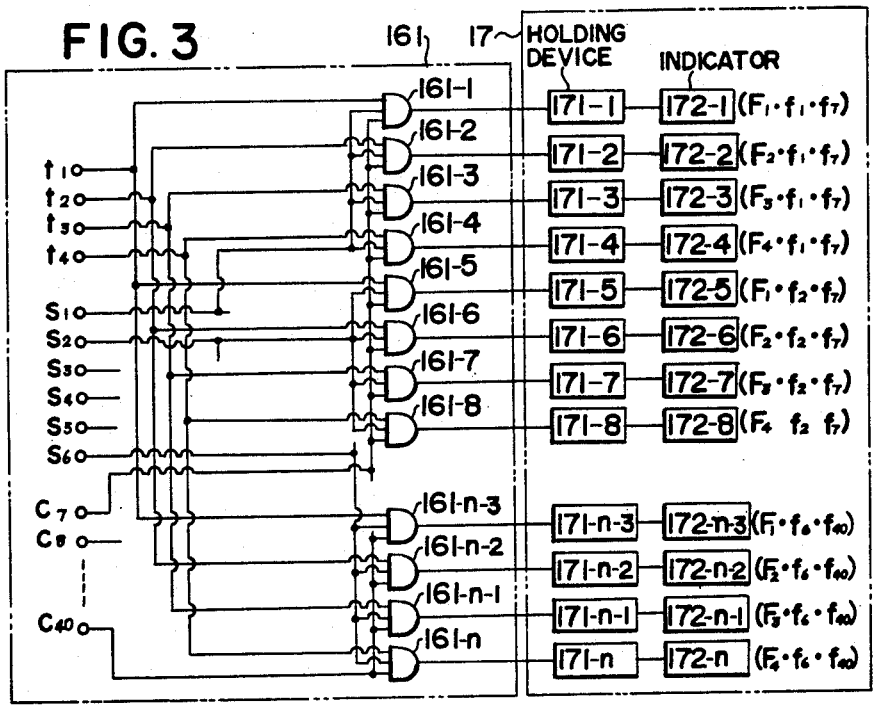
FIG. 3 is a block diagram showing in detail an exemplary construction of the AND gate unit and the display panel shown in FIG. 2.

FIG. 3 shows in detail the construction of the AND gate unit 161 and the display panel 17. In the Figure, the AND gate unit 161 comprises a plurality of AND gates 161-1 to 161-n whose input terminals are coupled in a matrix form to the input signals $t_1$ to $t_4$ corresponding to the types of the alarms, the input signals $S_1$ to $S_6$ corresponding to the respective group units or the branch coaxial cables and the input signals $C_7$ to $C_{40}$ corresponding to the respective subscribers in each of the group units. In the illustrated embodiment, the total number of the AND gates is $4\times6\times34=816$, and their output terminals are respectively connected to indicators 172-1 to 172-n through holding devices 171-1 to 171-n which may for example by thyristors having self-holding function. These holding devices and indicators constitute the display panel 17, and each of the indicators indicates, in accordance with the combination of frequencies indicated at its right such as ($F_1$, $f_1$, $f_7$), that which subscriber in which group unit has transmitted which alarm.

Figure 4:
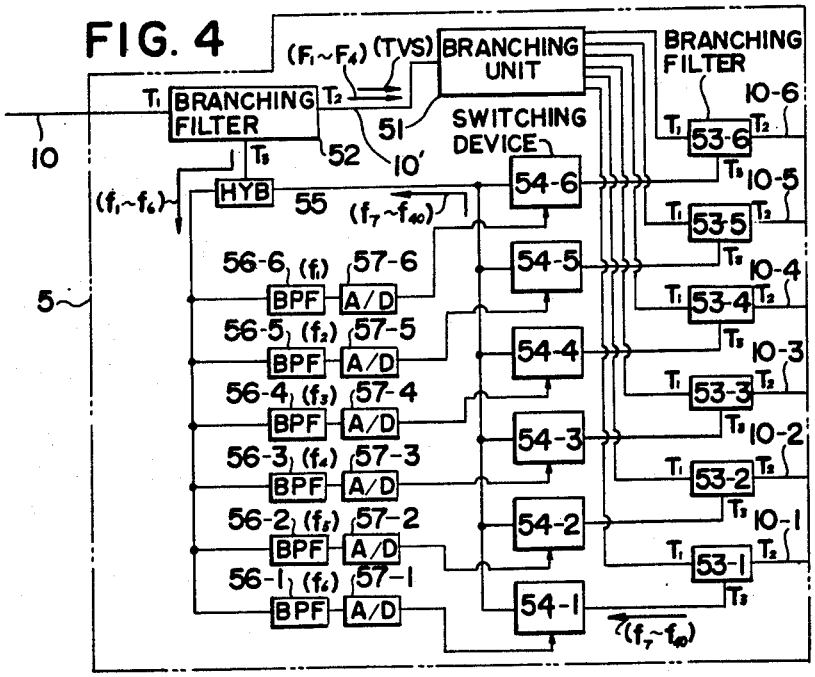
FIG. 4 is a block diagram showing in detail an exemplary construction of the repeater shown in FIG. 1.
Figure 6B:
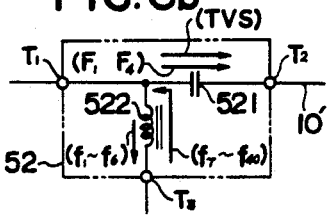
FIGS. 6*b* and 6*c* show detailed exemplary constructions of the separate branching filters shown in FIG. 4.
Figure 6C:
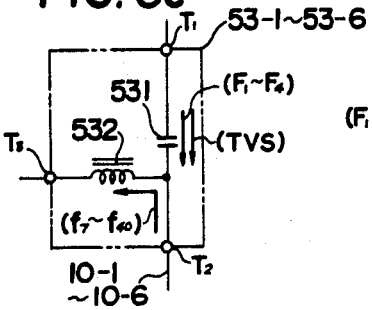

FIG. 4 shows in detail the construction of the repeater 5 which divides the coaxial cable 10 into the branch coaxial cables 10-1 to 10-6. In the Figure, the coaxial cable 10 is connected to a branching unit 51 through a branching filter 52 and a coupling line 10', and a plurality of branch coaxial cables, in the illustrated embodiment, six branch coaxial cables 10-1 to 10-6 are branched off the branching unit 51. Although the internal construction of the branching unit 51 is not shown, the branching unit 51 has a circuit construction the branching unit 51 has a circuit construction using a hybrid coil which branches the television signal TVC and the high frequency signal components $F_1$ to $F_4$ of the interrogating signals to the branch coaxial cables 10-1 to 10-6 without any power loss, and it is not much different from the ordinary branching unit which is in wide use for the CATV coaxial cable networks. In FIG. 4, numerals 53-1 to 53-6 designate another branching filters connected to the branch coaxial cables 10-1 to 10-6 which are branched off the branching unit 51, and each of the branching filters 53-1 to 53-6 comprises a high-pass filter 531 and a low-pass filter 532 as shown in FIG. 6c so that the down-signals (TVS and $F_1$ to $F_4$) are transmitted from the first terminals $T_1$ to the branch coaxial cables 10-1 to 10-6 through the second terminals $T_2$, and the up-signals ($f_7$ to $f_{40}$) from the branch coaxial cables 10-1 to 10-6 are transmitted from the second terminals $T_2$ to the corresponding switching devices 54-1 to 54-6 through the third terminals $T_3$.

The switching devices 54-1 to 54-6 comprise for example analog switching devices or transistor switching circuits so that the up-signals ($f_7$ to $f_{40}$) received from the branch coaxial cables 10-1 to 10-6 through the branching filters 53-1 to 53-6 are selectively transmitted to the coaxial cable 10 through a hybrid coupler 55 and the branching filter 52, and these switching devices are of the same type as the previously mentioned switching devices 131 to 136. Numerals 56-1 to 56-6 designate band-pass filters each comprising a mechanical filter or the like, whereby when the signal components $f_1$ to $f_6$ are applied from the coaxial cable 10 through the branching filter 52 and the coupler 55, these signal components are separated into the frequencies $f_1$ to $f_6$ and are applied to A/D converters 57-1 to 57-6. When the signal component of the corresponding frequency ($f_1$ to $f_6$) is received from the associated band-pass filter, one of the A/D converters 57-1 to 57-6 applies a control signal to the corresponding one of the switching devices 54-1 to 54-6. When the control signal is applied, one of the switching devices 54-1 to 54-6 transmits the up-signals from the branch coaxial cable to the coaxial cable as mentioned previously. The internal construction of the branching filter 52 is shown in FIG. 6b, namely, it comprises a high-pass filter 521 by which the down-signals from a first terminal $T_1$ connected to the coaxial cable 10 are transmitted to the branching unit 51 through a second terminal $T_2$ connected to the coupling line 10', and a low-pass filter 522 by which the low frequency down-signals $f_1$ to $f_6$ are transmitted from the first terminal $T_1$ to a third terminal $T_3$ connected to the hybrid coupler 55 and the low frequency up-signals $f_7$ to $f_{40}$ are transmitted from the third terminal $T_3$ to the first terminal $T_1$. The hybrid coupler 55 is an ordinary low frequency hybrid coupler by which the low frequency down-signals from the third terminal $T_3$ of the branching filter 52 are transmitted to the band-pass filters 56-1 to 56-6 and the low frequency up-signals $f_7$ to $f_{40}$ from the switching devices 54-1 to 54-6 are transmitted to the third terminal $T_3$ of the branching filter 52.

Figure 6D:
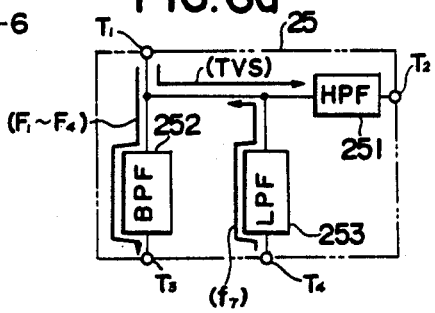
FIG. 6*d* is a block diagram showing in detail an exemplary construction of the filter equipment shown in FIG. 5.

FIG. 2 shows an exemplary internal construction of the subscriber station 9, and the construction of its filter equipment 25 is shown in detail in FIG. 6d.

The television signal TVS and the high frequency signal components $F_1$ to $F_4$ of interrogating signals are transmitted as down-signals to the branch coaxial cables 10-1 to 10-6, and the down-signals are transmitted, as shown in FIG. 1, to the subscriber stations 9 through high-pass filters 62 and 63 and amplifier 61 of the bidirectional amplifier unit 6 and through the splitter 7 and the tap-offs 8. The answer signals of frequencies $f_7$ to $f_{40}$ generated from the subscriber stations 9 are transmitted as up-signals through the tap-offs 8, the splitter 7 and a low-pass filter 64 of the unit 6 and are applied to the repeater 5 through the branch coaxial cables 10-1 to 10-6.

Figure 5:
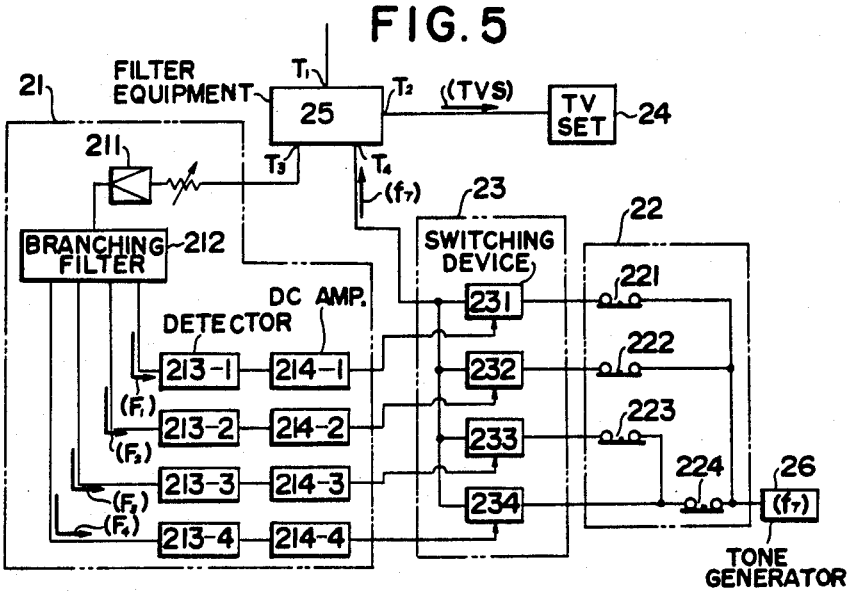
FIG. 5 is a block diagram showing in detail an exemplary construction of the subscriber station shown in FIG. 1.

Each of the subscriber stations 9 is constructed as shown in FIG. 5, and a plurality of the subscriber stations 9 are connected to each of the tap-offs 8 connected to each splitter 7, and in the illustrated embodiment thirty four units of the subscriber station are connected to each branch coaxial cable to form a group unit. The low frequencies $f_7$ to $f_{40}$ are respectively assigned to the thirty four subscriber stations, and each of another group units formed for the respective branch coaxial cables includes thirty four units of the subscriber station which are similarly connected to the branch coaxial cable and to which the frequencies $f_7$ to $f_{40}$ are assigned. The subscriber station 9 shown in FIG. 5 is the first subscriber which is connected to the branch coaxial cable 10-1 selected by the frequency component $f_1$ of the interrogating signal as will be described later, and the frequency $f_7$ is assigned to it for the answer signal. The subscriber 9 includes a tone generator 26 forming a low frequency oscillator for generating a signal of the frequency $f_7$ assigned to it as the answer signal, and the output of the tone generator 26 is transmitted as an up-signal to the coaxial cable line through a switch unit 22 comprising a fire alarm switch 221, a gas leakage switch 222, a crime preventive emergency alarm switch 223 and an absence signal switch 224 and a controller 23 comprising switching devices 231, 232, 233 and 234 and through the filter equipment 25 and tap-off 8.

The subscriber station 9 includes the filter equipment 25 such as shown in FIG. 6d, whereby the low frequency up-signal is transmitted to the cable line through the tap-off, and the television signal TVS and the interrogating signal high frequency components $F_1$ to $F_4$ applied from the cable line as down-signals are respectively transmitted to the TV set 24 and a discriminator 21. In other words, in FIG. 6d the television signal TVS applied to a first terminal $T_1$ connected to the tap-off 8 is transmitted to the TV set 24 from a second terminal $T_2$ through a high-pass filter 251, and the interrogating signal components $F_1$ to $F_4$ applied to the first terminal $T_1$ are transmitted to the discriminator 21 from a third terminal $T_3$ through a band-pass filter 252. On the other hand, the answer signal or the low frequency up-signal from the controller 23 is applied to a fourth terminal $T_4$ from which the signal is transmitted to the tap-off 8 through a low-pass filter 253 and the first terminal $T_1$.

Referring again to FIG. 5, the discriminator 21 functions so that when the interrogating signal components $F_1$ to $F_4$ are applied, the switching devices respectively corresponding to $F_1$, $F_2$, $F_3$ and $F_4$ are selectively actuated, and it comprises a high frequency amplifier 211 for amplifying input signals $F_1$, $F_2$, $F_3$ and $F_4$, a branching filter 212 for separating the signals $F_1$ to $F_4$ into the frequencies $F_1$, $F_2$, $F_3$ and $F_4$, detectors 213-1 to 213-4 for respectively detecting the signals $F_1$ to $F_4$ separated by the filter 212 and DC amplifiers 214-1 to 214-4 for respectively amplifying the detector outputs. As a result, when the signal $F_1$ is for example applied to the discriminator 21, the detector 213-1 generates an output which in turn is amplified by the DC amplifier 214-1 and applied as a control signal to the switching device 231, and consequently the output of the tone generator 26 is transmitted to the tap-off 8 through the switch 221, the switching device 231 actuated by the control signal and the low-pass filter 253 of the filter equipment 25. In this case, if the fire alarm switch 221 has been actuated, the output of the tone generator 26 is not delivered and this servers as an answer signal indicating the occurrence of an abnormal condition. In the illustrated embodiment, each of the alarm switches 221 to 224 comprises normally closed contacts so as to effect the detection of a break in the cable line as will be described later, and the switches, e.g., the fire alarm switch 221 and the gas leakage alarm switch 222 may each be comprised of an automatic switch which is opened by the operation of an abnormal condition monitoring sensor.

The operation of the above-described embodiment will now be described with reference to FIGS. 1 to 6.

Firstly, the television signal TVS is received by the community antenna 1 from which the signal is applied to the first terminal $T_1$ of the signal separator 3 through the head end 2. In the signal separator 3, the television signal TVS applied to the first terminal $T_1$ is delivered as such to the second terminal $T_2$ through the high-pass filter 31. The television signal TVS is transmitted from the second terminal $T_2$ of the separator 3 to the coaxial cable 10 from which the signal is applied to the repeater 5 in which the signal is delivered from the first terminal $T_1$ of the repeater to the coupling line 10' through the high-pass filter 521, and then the signal is applied to the branching unit 51 from which the signal is branched and transmitted to the branch coaxial cables 10-1 to 10-6 through the associated branching filters 53-1 to 53-6. The television signal TVS applied to each branch coaxial cable is amplified by the amplifier 61 of the bidirectional amplifier unit 6 and then the signal is further divided and delivered through the bidirectional splitter 7 to a plurality of the tap-offs 8 from each of which the signal is further divided to a plurality of the subscriber stations 9. In each subscriber station 9, the television signal TVS is delivered from the first terminal $T_1$ of the filter equipment 25 through the high-pass filter 251 and received by the television receiving set 24 connected to the second terminal $T_2$. In the illustration embodiment, assuming that the VHF band of 108 to 174 MHz is assigned to the high frequency signal components $F_1$ to $F_4$ for interrogating signals as mentioned previously and that the voice frequency band, e.g., a low frequency band of 1 to 4 KHz is assigned to the low frequency signal components $f_1$ to $f_6$ and to the output signal frequencies $f_7$ to $f_{40}$ of the tone generators in the subscriber stations, the pass band of the high-pass filters 31 and 251 of the signal separator 3 and the filter equipment 25 is selected to extend from 54 MHz to 870 MHz, the low-pass filters 32 and 253 are selected to pass only the low frequency signals of less than 4 KHz and the pass band of the band-pass filters 33 and 252 is selected to extend from 108 to 174 MHz. On the other hand, the high-pass filters 521 and 531 of the branching filters 52 and 53-1 to 53-6 are selected to pass only the high frequency signals of over 54 MHz, and their low-pass filters 522 and 532 are also selected to pass only the low frequency signals of less than 4 KHz. By thus selecting the filters, the television signal TVS is received by the television receiving set 24 of each subscriber station through the above-mentioned route.

With the system described above, the transmission and reception of alarms are effected in the following manner. In the central station 4, the oscillators 141 to 144 of the oscillator circuit 14 generate respectively signal outputs of frequencies $F_1$ to $F_4$, and the oscillators 191 to 196 of the oscillator circuit 19 respectively generate signal outputs of frequencies $f_1$ to $f_6$. The clock pulse generator 151 generates clock pulses of a predetermined period so that in response to every clock pulse applied, the shift register 152 generates a "1" signal at one of its output terminals, and the control signals $t_1$ to $t_4$ are sequentially changed to a "1" signal, that is, the control signal $t_1$ is first changed to a "1" signal and then the next control signal $t_2$ is changed to a "1" signal and the control signal $t_1$ is returned to a "0" signal and so on, and this process is repeated thus periodically changing the control signals to shift the "1" signal. The control signals, $S_1$ to $S_6$ are similarly periodically changed with a different timing of changes, that is, a change occurs in response to the counting of every four clock pulses by the counter 153. The counter 153 applies a shift pulse to the shift register 154 for every four clock pulses. As a result, during the time interval that the signal $S_1$ is a "1" signal, for example, one cycle of sequentially changing the signals $t_1$ to $t_4$ to a "1" signal is accomplished, and on completion of this cycle the next signal $S_2$ changes to a "1" signal thus causing the similar cycle of sequentially changing the signals $t_1$ to $t_4$ to a "1" signal. In response to the sequential changing of the control signals $t_1$ to $t_4$ to a "1" signal, the switching devices 121 to 124 are sequentially actuated thus applying to the mixer 181 the output of the oscillator of the oscillator circuit 14 which is connected to the actuated switching device, and also each time one of the control signals $S_1$ to $S_6$ changes to a "1" signal, one of the switching devices 131 to 136 is actuated thus applying to the hybrid coupler 183 the output of the oscillator of the oscillator circuit 19 which is connected to the actuated switching device. At the same time, the control signals $t_1$ to $t_4$ and $S_1$ to $S_6$ are applied as gate input signals to the AND gate unit 161. By thus sequentially actuating the switching devices 121 to 124 and 131 to 136, as shown in the time chart of FIG. 7, the high frequency signals $F_1$ to $F_4$ are sequentially applied from the central station 4 to the third terminal $T_3$ of the signal separator 3, and at the same time the low frequency signals $f_1$ to $f_6$ are sequentially applied at the period corresponding to one cycle time of the signals $F_1$ to $F_4$. Thus, these signals are delivered as interrogating signals to the coaxial cable 10 through the band-pass filter 33 and the low-pass filter 32 for use as polling down-signals.

Figure 7:
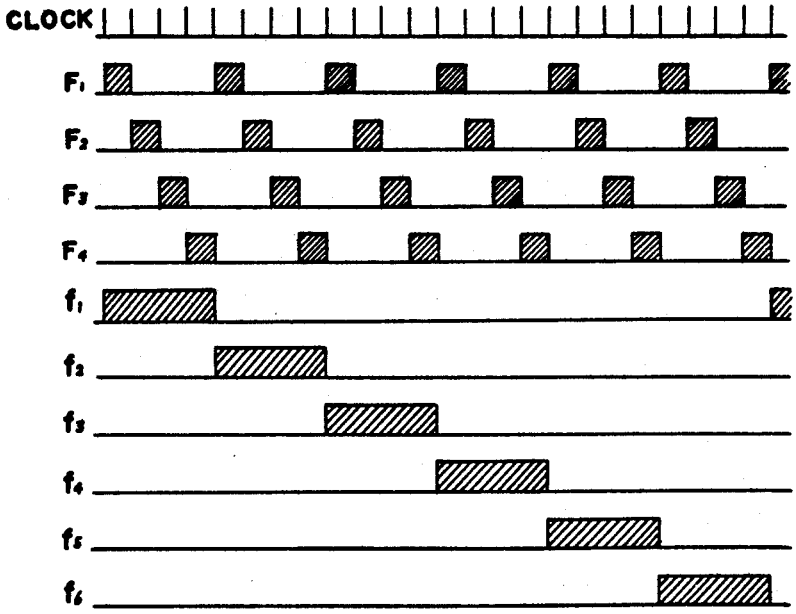
FIG. 7 is a time chart showing the frequency components of interrogating signals during polling.

When applied to the repeater 5, the high frequency signals $F_1$ to $F_4$ are passed through the branching filter 52 to the branching unit 51 from which the signals are devided and transmitted to the branch coaxial cables 10-1 to 10-6 through their associated branching filters 53-1 to 53-6. As a result, the signals $F_1$ to $F_4$ are transmitted to all the subscriber stations 9 simultaneously similarly with the television signal. In each of the subscriber stations 9, the filter equipment 25 separates the signals $F_1$ to $F_4$ from the television signal, and after amplication by the amplifier 211, the signals $F_1$ to $F_4$ are separated by the branching filter 212 into the respective frequency components $F_1$, $F_2$, $F_3$ and $F_4$ which in turn are respectively detected by the detectors 213-1 to 213-4. In other words, as shown in FIG. 7, the signals $F_1$ to $F_4$ are sequentially transmitted periodically and consequently the outputs of the detectors 213-1 to 213-4 are sequentially generated periodically. These detector outputs are respectively amplified by the DC amplifiers 214-1 to 214-4 and are then applied to the switching devices 231 to 234, thus sequentially actuating the switching devices 231 to 234 periodically. Consequently, the acutated switching device delivers the output signal of the tone generator 26 to the fourth terminal $T_4$ of the filter equipment 25 through the switch unit 22 so that each of the subscriber stations delivers the output signal of the tone generator to the branch coaxial cable through the tap-off 8 in synchronism with the signals $F_1$ to $F_4$. In other words, the low frequency signals or up-signals $f_7$ to $f_{40}$ are applied to the branch coaxial cables 10-1 to 10-6, respectively, with the same periodical changes as the signals $F_1$ to $F_4$. In the repeater 5, the low frequency signal components $f_1$ to $f_6$ applied from the central station 4 through the coaxial cable 10 are received through the branching filter 52 and the hybrid coupler 55 so that the signals $f_1$ to $f_6$ are respectively separated by the band-pass filters 56-1 to 56-6 into the frequency components $f_1$ to $f_6$ and these components are respectively detected by the A/D converters 57-1 to 57-6. The A/D converters 57-1 to 57-6 sequentially generate an output signal periodically at the period of the signals $f_1$ to $f_6$, and these output signals similarly sequentially actuate the switching devices 54-1 to 54-6 periodically.

The signals $f_7$ to $f_{40}$ applied from all the subscriber stations 9 to the branch coaxial cables 10-1 to 10-6, respectively, are respectively passed from the second terminal $T_2$ to the third terminal $T_3$ through the low-pass filter 532 of the branching filters 53-1 to 53-6, respectively, and consequently when the switching devices 54-1 to 54-6 are sequentially actuated periodically in synchronism with the signals $f_1$ to $f_6$, the signals $f_7$ to $f_{40}$ are passed to the coaxial cable 10 through the actuated switching device and through the hybrid coupler 55 and the low-pass filter 522 of the branching filter 52. In other words, the branch coaxial cables 10-1 to 10-6 are sequentially selected in response to the periodic change of the signals $f_1$ to $f_6$, so that the signals $f_7$ to $f_{40}$ applied to the branch coaxial cables are selectively transmitted as the up-signals to the central station 4 and the low frequency signals simultaneously containing all the low frequency components $f_7$ to $f_{40}$ and synchronized with the signals $F_1$ to $F_4$ are sequentially applied from the branch coaxial cables 10-1 to 10-6, cable by cable, to the central station 4 periodically.

In the signal receiving circuit 16 of the central station 4, the low frequency signals containing all the low frequency components $f_7$ to $f_{40}$ are received from the hybrid coupler 183 and the signals are separated into the respective low frequency components $f_7$ to $f_{40}$ through the bandpass filter 162-7 to 162-40. As a result, the resulting low frequency signals separated into the respective low frequency components are respectively concerted to a "1" signal through the A/D converters 163-7 to 163-40 and the "1" signals are applied as signals $C_7$ to $C_{40}$ to the AND gate unit 161 through inverters 164-7 to 164-40. In other words, when all of the subscriber stations find no abnormal condition, all the inverters 164-7 to 164-40 generate "0" signals in synchronism with the signals $F_1$ to $F_4$ or the signals $t_1$ to $t_4$ so that all the AND gates 161-1 to 161-n are closed and all of the indicators 172-1 to 172-n are not actuated. In this case, when there is a break in the cable leading to any subscriber station, the branch coaxial cable to which the disconnected subscriber station is connected is supplied with the low frequency up-signals which do not contain one of the low frequency components $f_7$ to $f_{40}$ which is assigned to the disconnected subscriber station, so that when this branch coaxial cable is selected by the corresponding one of the signals $f_1$ to $f_6$, namely, when, for example, the branch coaxial cable is selected by the signal $f_1$ and the control signal $S_1$ corresponding to the signal $f_1$ is applied to the AND gate unit 16, a "0" signal is applied, in response to each of the signals $F_1$ to $F_4$, to that inverter which corresponds to the low frequency assigned to the disconnected subscriber station and the inverter generates a "1" signal. Thus, the four AND gates to which are applied the signal $S_1$ and the output of the inverter generating the "1" signal, receive "1" signals at all the inputs, so that the corresponding four units of the holding devices 171-1 to 171-n are triggered and the corresponding four indicators are actuated. In other words, when the indicators of all the types of the alarms corresponding to any subscriber station are simultaneously actuated, if all of the alarm switches of this particular subscriber station are not in operation, it is an indication that there is a break in the line leading to this particular subscriber station. If this break is a contact failure at the tap-off 8 of the subscriber station, for example, the corresponding four indicators will be brought into operation, whereas when this break takes place at a location which is closer to the repeater 5 than to the splitter 7 of any branch coaxial cable, the break will bring into operation all the indicators corresponding to all the subscriber stations connected to this particular branch coaxial cable. Thus, the pattern of indicator operation differs depending on the location of break and consequently it is possible to guess the location of a break with some accuracy.

In the subscriber station shown in FIG. 5, the tone generator 26 generates an output of low frequency $f_7$ and the subscriber station is connected to the branch coaxial cable 10-1. Assume for example that the fire alarm switch 221 is opened manually or automatically, the signal component $f_7$ will not be present in the low frequency signals received by the central station 4 during the time duration of the transmitted signal $f_1$ with the signal $F_1$ also being transmitted, so that at this time a "0" signal is applied to the inverter 164-7 alone and thus the output $C_7$ of the inverter 164-7 goes to a "1" signal and the outputs $C_8$ to $C_{40}$ of the other inverters 164-8 to 164-40 each goes to a "0" signal. When this occurs, only the AND gate 161-1 receives a "1" signal at each of its three input terminals so that the holding device 171-1 is triggered by a "1" signal output of the AND gate 161-1 and the indicator 172-1 is continuously actuated thus indicating that the fire alarm switch 221 has been opened in the subscriber station having the frequency $f_7$ in the group of the branch coaxial cable 10-1. When, in the same subscriber station, the other alarm swithces 222, 223 and 224 are opened, the corresponding indicators 172-2, 172-3 and 174-4 are correspondingly actuated. Of course, the same applies to the other subscriber stations, and when a plurality of the subscriber stations simultaneously give alarms, a plurality of the corresponding indicators are simultaneously actuated.

With the above-described indicator operation, if the interval between the signals $F_1$ to $F_4$ causes an erroneous operation of the holding devices, this may be eliminated by providing a delay corresponding to the interval to the input of the holding devices.

While, in the embodiment described above, the high frequencies in the VHF band are assigned to the polling signals $F_1$ to $F_4$ for the different alarms and the low frequencies are assigned to the polling signals $f_1$ to $f_6$ for the group units or the branch coaxial cables and to the signals $f_7$ to $f_{40}$ for discriminating the subscriber stations, this is for the purpose of effectively utilizing the transmission characteristic of the CATV coaxial cable network by assigning the frequencies in the VHF band to the signals $F_1$ to $F_4$ which must be transmitted to the terminal ends of the cable line, and consequently if it is permissible, it is possible to assign the low frequencies to the signals $F_1$ to $F_4$ and $f_7$ to $f_{40}$ and the high frequencies to the signals $f_1$ to $f_6$.

Figure 9:
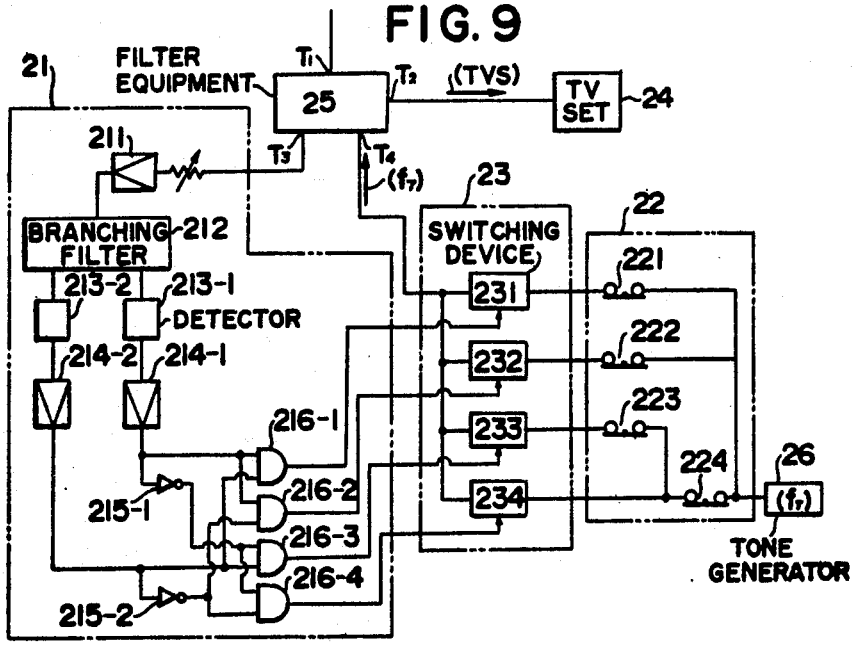
FIG. 9 is a block diagram showing in detail an exemplary construction of the subscriber station used with the central station of FIG. 8.
Figure 8:
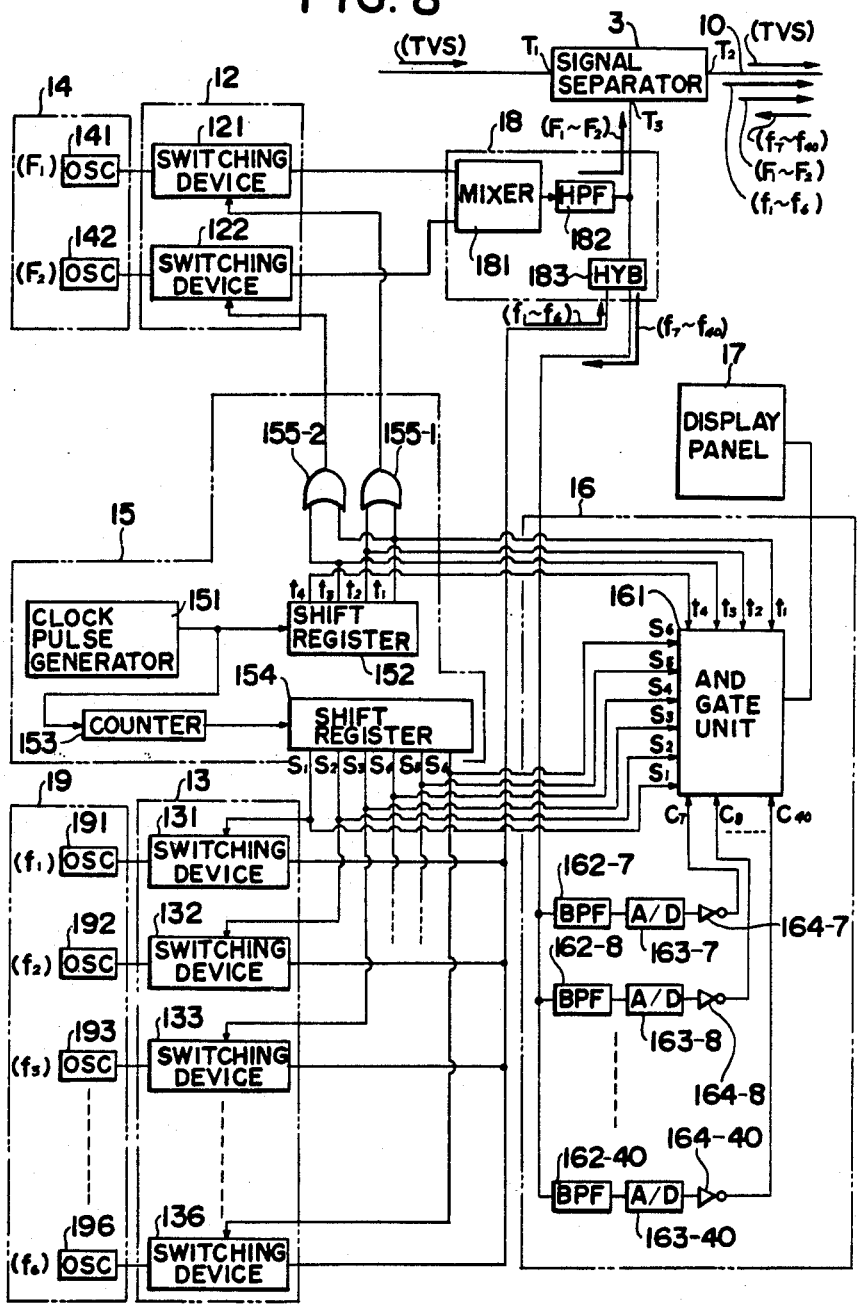
FIG. 8 is a block diagram showing in detail an exemplary construction of a centraL station according to another embodiment of the invention.

FIGS. 8 and 9 show in detail the construction of the central station 4 and the subscriber stations 9 used in another embodiment of this invention. In this embodiment, the number of oscillators used is reduced by generating the required polling signals for the different alarms in the form of code signals comprising the combination of the outputs of two high frequency oscillators. In other words, the blocks constituting the internal construction of the stations 4 and 9 are identical with the counterparts of the first embodiment except the switching circuit 12, the oscillator circuit 14 and the mixer 181 in the central station 4 and OR gates 155-1 to 155-2 are added to the synchronizing signal generator 15. As regards the construction of the subscriber stations 9, the construction of the discriminators 21 differs from the counterpart in the first embodiment.

In the embodiment shown in FIGS. 8 and 9, only the two output frequencies $F_1$ to $F_2$ of oscillators 141 and 142 are used to produce the required polling signals for the different alarms, and the operation of switching devices 121 and 122 are controlled in the following manner by the output signals $t_1$ to $t_4$ of the shift register 152 through the OR gates 155-1 and 155-2. In other words, when the signal $t_1$ is a "1" signal, both the switching devices 121 and 122 are actuated to apply signals $F_1$ and $F_2$ to the mixer 181 and the presence of the two signals $F_1$ and $F_2$ is designated for alarm the occurrence of a fire. When the signal $t_2$ is a "1" signal, only the switching device 121 is actuated to apply only the signal $F_1$ to the mixer 181, and consequently the presence of the signal $F_1$ is designated for gas learkage alarm purposes. When the signal $t_3$ is a "1" signal only the switching device 122 is actuated to apply only the signal $F_2$ to the mixer 181 and consequently the presence of the signal $F_2$ alone is designated for crime preventive emergency alarm purposes. Also, when the signal $t_4$ is a "1" signal, both the switching devices 121 and 122 are not actuated to apply no signal to the mixer 181, and consequently the absence of the two signals $F_1$ and $F_2$ is designated for absence alarm purposes.

As regards the interrogating signals, firstly the signal $f_1$ is generated along with the signals $F_1$ and $F_2$, then the signals $f_1$ and $F_1$, then signals $f_1$ and $F_2$ and lastly the signal $f_1$ alone. This constitutes one cycle of the polling for the four different types of alarms which is effected on the branch coaxial cable 10-1 in response to the signal $f_1$. After this cycle, another one cycle of polling for the four different types of alarms is effected on the branch coaxial cable 10-2 in response to the signal $f_2$, and the similar one cycle of polling is effected in response to each of the remaining signals $f_3$ to $f_6$. This process is effected repeatedly.

Each of the code signals comprising the combinations of signals $F_1$ and $F_2$ is applied simultaneously to all the subscriber stations, and the switching devices 231, 232, 233 and 234 are controlled through a logic circuit comprising inverters 215-1 and 215-2 and AND gates 216-1, 216-2, 216-3 and 216-4 in accordance with the combination of the signals $F_1$ and $F_2$. In other words, when both the signals $F_1$ and $F_2$ are applied the AND gate 216-1 generates a "1" signal to actuate the switching device 231, when only the signal $F_1$ is applied the AND gate 216-2 generates a "1" signal to actuate the switching device 232, when only the signal $F_2$ is applied the AND gate 216-3 generates a "1" signal to actuate the switching device 233, and when both the signals $F_1$ and $F_3$ are not applied the AND gate 216-4 generates a "1" signal to actuate the switching device 234. As a result, when there is no irregularity in any of the subscribers stations, the low frequency signals $f_7$ to $f_{40}$ are always present on each branch coaxial cable, and the central station 4 determines this condition to be normal as is the case with the first embodiment. On the other hand, when an abnormal condition occurs in any one of the subscribers stations, one of the alarm switches 221 to 224 corresponding to the type of the abnormal condition is opened, so that when the interrogating signal of the code content corresponding to the type of the abnormal condition is generated from the central station, 4, the subscriber station having the abnormal condition no longer generates the low frequency signal having one of the frequencies $f_7$ to $f_{40}$ assigned to the subscriber station, and thus the corresponding indicator of the central station is actuated to indicate the location and type of the abnormal condition.

It will thus be seen from the foregoing detailed description that in accordance with the present invention a so-called simultaneous polling of all the subscriber stations for every type of alarm is accomplished to allow each subscriber station to answer at a frequency assigned to it, and the descrimination of the group units is effected by differing the time of reception of answer signals, thus making it possible to service a large number of subscriber stations with a reduced number of frequencies used. In other words, in accordance with the present invention the total number N of the frequencies used will be given by $N=l+n+m$, where m is the number of frequencies $F_1$, $F_2$. . . for designating the types of alarms, is the number of group unit selecting frequencies $f_1$, $f_2$. . . and n is the number of subscriber stations in each group unit, and the number of the required oscillators will be N at most. On the contrary, with the known ordinary polling system in which the subscribers are polled from the central station to answer, it is necessary that the central station is provided with as many frequencies as the total number of subscribers $l \cdot n$ and the subscribers are provided as many frequencies as the number of types of alarms m, thus requiring a total of $N'=l \cdot n+m$ frequencies which are different from one another. The difference between the two is the difference between the sum and the product, and consequently the difference increases as the value of l and n increase, thus making it practically impossible to perform the prior art system depending on increase in the value of l and n. A reduction in the total number of required frequencies means that the number of subscribers can be increased correspondingly and thus the present invention can be applied to large scale CATV systems. Of course, the reduction in the number of frequencies used results in a reduction in the types and number of oscillators and the difference between the frequencies can be made considerably great, thus making it unnecessary to use high performance filters having excellent selectivity and thereby ensuring reduction in the manufacturing cost. Moreover, although the prior art system in which the subscribers are sequentially polled and require an answer about the presence or absence and type of abnormal condition, it follows that a considerable time passes before all of the subscribers finish their answer. This time is considerably decreased by the system of this invention in which the subscribers are polled for every type of alarm and all the subscribers in the same group unit answer simultaneously.

What is claimed is:

1. In an alarm system utilizing a bidirectional CATV system for remotely monitoring a plurality of subscribers of said CATV system from a central station connected to said CATV system, the improvement comprising:

(a) a plurality of subscribers stations each located at each subscriber's location and having locations in group units;

(b) a plurality of tone generators each provided in the corresponding one of said subscriber stations, said tone generators generating up-signals of first frequencies common to respective of said group units, said first frequencies being different for respective subscribers in respective group units;

(c) means disposed in said central station for sequentially generating a plurality of first signal components of different frequency components respectively corresponding to a plurality of types of alarm contents, said plurality of first signal components being periodically generated repeatedly, the frequencies of said first signal components being different from said first frequencies of said up-signals;

(d) means disposed in said central station for generating a plurality of second signal components of different frequency components respectively corresponding to said plurality of group units, said plurality of second signal components being periodically generated repeatedly, the frequencies of said second signal components being different from the first frequencies of said up-signals and the frequencies of said first signal components;

(e) synchronizing means disposed in said central station for controlling the duration time of each signal component and the repetition period of said first and second signal components in such a manner that one cycle of repetition of one of said first and second signal components is completed within the duration time of each signal component of the other of said first and second signal components;

(f) means for delivering said first and second signal components as interrogating signals from said central station to a transmission cable of said CATV system;

(g) repeater means disposed in said transmission cable and including means for branching and transmitting the first signal components in said interrogating signals to each of said group units;

(h) a plurality of alarm switch means disposed in each of said subscriber stations and connected to said tone generator therein, whereby when an abnormal condition occurs in the location of each said subscriber station, one of said alarm switch means corresponding to the said abnormal condition is actuated;

(i) discriminating means disposed in each said subscriber station for receiving, separating and detecting the respective frequency components of said first signal components;

(j) controlling means disposed in each said subscriber station whereby in response to the detection outputs of said discriminating means, operation and non-operation of said alarm switch means are sequentially polled so as to sequentially control the delivery of the outputs of said tone generator to said transmission cable through said alarm switch means as said up-signals;

(k) means disposed in said repeater means for receiving said second signal components and separating the same into the respective frequency components to generate a plurality of detection signals;

(l) means disposed in said repeater means for separately receiving said up-signals from said group units, whereby in response to said detection signals corresonding to the frequency components of said second signal components, said up-signals from said group units are sequentially transmitted group by group to said central station through said transmission cable in synchronism with the period of said second signal components;

(m) means disposed in said central station for receiving said up-signals through said transmission cable to separate the same into said first frequencies and generate a plurality of detection outputs;

(n) a plurality of AND gate means disposed in said central station for receiving in a matrix manner at the inputs thereof a plurality of first binary codes each having a signal content indicative of the presence or absence of corresponding one of said plurality of first signal components, a plurality of second binary code signals each having a signal content indicative of the presence or absence of corresponding one of said plurality of second signal components, and a plurality of third binary code signals each having a signal content indicative of the presence or absence of corresponding one of said plurality of detection outputs; and (o) a plurality of indicator means disposed in said central station, each of said indicator means being operable by an output of corresponding one of said plurality of AND gate means.

2. An alarm system as set forth in claim 1, wherein said means for generating said plurality of first signal components includes a plurality of VHF oscillators, and wherein said means for generating said plurality of second signal components includes a plurality of low frequency oscillators, whereby said first signal components transmitted from said central station to said subscriber stations fall within a predetermined transmission band width, of said transmission cable of said CATV system.

3. An alarm system as set forth in claim 1, wherein said plurality of alarm switch means include a plurality of normally closed contacts connected in series with each of said tone generators whereby when said alarm switch means are not in operation, said up-signals are transmitted from all said subscriber stations to said transmission cable in synchronism with said first signal components, and when any of said up-signals present on said transmission cable disappear, said indicator means corresponding to said disappeared up-signals are actuated in said central station.

4. An alarm system as set forth in claim 1, wherein said synchronizing means controls the duration time of each signal component and the repetition period of said plurality of first signal components and said plurality of second signal components in such a manner that one cycle of repetition of said plurality of first signal components is completed within the duration time of each of said plurality of second signal components.

5. An alarm system as set forth in claim 1, wherein said synchronizing mean controls the duration time of each signal component and the repetition period of said plurality of first signal components and said plurality of second signal components in such a manner that one cycle of repetition of said plurality of second signal components is completed with in the duration time of each of said plurality of first signal components.

6. An alarm system as set forth in claim 1, wherein said synchronizing means includes a combination of a clock pulse generator and a first shift register for controlling the duration time of each signal component and the repetition cycle of one of said first signal components and said second signal components, and a combination of a second shift register and a counter connected to said clock pulse generator for controlling the duration time of each signal component and the repetition cycle of the other of said first signal components and said second signal components, and wherein said first shift register is directly driven by said clock pulse generator, said second shift register is driven by said clock pulse generator through said counter, and said counter applies a drive pulse signal to said second shift register when the count of said counter reaches a number of output bits of said first shift register.

7. An alarm system as set forth in claim 1, wherein said central station includes means for sequentially generating a plurality of first signal components of different frequencies corresponding respectively to a plurality of types of alarms, said plurality of first signal component being periodically generated repeatedly, and wherein said discriminating means in each said subscriber station isresponsive to the frequencies of said first signal components to generate a plurality of detection outputs for sequentially controlling said plurality of alarm switch means.

8. An alarm system as set forth in claim 1, wherein said first signal component generating means of said central station generates as said first signal components a plurality of signals of different code contents respectively corresponding to a plurality of types of alarm contents and each comprising a combination or presence and absence of a plurality of different frequency signals, said plurality of first signal components being periodically generated repeatedly, and wherein said discriminating means in each said subscriber station includes a logic circuit for detecting the code contents of said first signal components in accordance with the combination and presence and absence of said frequency signals to generate, in accordance with said code contents, a plurality of detection outputs for sequentially controlling said plurality of alarm switch means.

* * * * *